US008851620B1

(12) United States Patent
Oba et al.

(10) Patent No.: US 8,851,620 B1
(45) Date of Patent: Oct. 7, 2014

(54) IMAGE FORMATION DEVICE AND TRANSPORT CONTROL METHOD FOR RECORDING MEDIUM

(71) Applicant: Seiko Epson Corporation, Tokyo (JP)

(72) Inventors: Masashi Oba, Shiojiri (JP); Daiki Tokushima, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/203,176

(22) Filed: Mar. 10, 2014

(30) Foreign Application Priority Data

Mar. 19, 2013 (JP) ..... 2013-056288

(51) Int. Cl.
*B41J 29/393* (2006.01)
*B65H 43/00* (2006.01)
*B41J 15/16* (2006.01)

(52) U.S. Cl.
CPC ..... *B41J 15/165* (2013.01); *B65H 43/00* (2013.01)
USPC ..... 347/19

(58) Field of Classification Search
USPC ..... 347/19
See application file for complete search history.

(56) References Cited

U.S. PATENT DOCUMENTS 8,287,080 B2 * 10/2012 Endo ..... 347/19
8,646,869 B2 * 2/2014 Yamazaki ..... 347/19
8,702,195 B2 * 4/2014 Aramendia et al. ..... 347/19

FOREIGN PATENT DOCUMENTS

JP 10-086472 4/1998

* cited by examiner

*Primary Examiner* — Lamson Nguyen
(74) *Attorney, Agent, or Firm* — Workman Nydegger

(57) ABSTRACT

An image formation device includes a transport section that transports a recording medium in a transport direction, a width-direction positional change section that changes a position of the recording medium in a width direction, a detector that detects a position of an edge of the recording medium in the width direction within a detection area, a control section that performs width-direction positional control by operating the width-direction positional change section in accordance with a detection result of the detector and by performing feedback control on the position of the recording medium in the width direction, and an image formation section that is located so as to face the recording medium and performs image formation on the recording medium. The control section performs control, during the image formation, in a first control mode where the width-direction positional control is performed with a first frequency response characteristic corresponding to a frequency band including a high frequency band or in a second control mode where the width-direction positional control is performed with a second frequency response characteristic corresponding to a frequency band lower than the high frequency band.

12 Claims, 7 Drawing Sheets

IMAGE FORMATION DEVICE AND TRANSPORT CONTROL METHOD FOR RECORDING MEDIUM

BACKGROUND

1. Technical Field

The present invention relates to a technique for transporting a recording medium, on which image formation is performed, in a transport direction. In particular, the invention relates to a technique for adjusting a position of the recording medium in a width direction, which intersects the transport direction.

2. Related Art

In JP-A-10-086472, an image formation device is described in which images are formed on a continuous sheet of paper by a printing section which faces the continuous sheet of paper while the continuous sheet of paper is transported in the transport direction. In such an image formation device, if the continuous sheet of paper is slanted with respect to the printing section when being transported, the device may fail to perform appropriate image formation on the continuous sheet of paper. In the image formation device of JP-A-10-086472, the position of the recording medium is adjusted in the width direction by a skew correction section, whereby the slant of the transported continuous paper with respect to the printing section is corrected.

In order to appropriately adjust the position of a recording medium such as a sheet of continuous paper in the width direction, the position of the recording medium may be subjected to feedback control in accordance with a detection result of the position of an edge of the recording medium. In such a manner, the position of the transported recording medium can be appropriately adjusted for an image formation section forming images. In this case, in order to preferably form images on the recording medium, small positional changes of the edge of the recording medium need to be rapidly reacted to in order to stabilize the position of the recording medium. However, while the rapid reaction of a control system performing feedback control enables favorable image formation, the following problem is caused.

Since a positional change of the edge of the recording medium during image formation is relatively small, an amount of positional change of the recording medium made by the control system is also relatively small. However, in the image formation device, operations other than image formation may be performed. In such operations, sharp signals which are not used in image formation may be input to the control system. If the control system reacts rapidly to such signals, the position of the recording medium will be abruptly changed by the control system, which may cause the recording medium to become wrinkled.

SUMMARY

An advantage of some aspects of the invention is that a technique is provided which realizes favorable image formation by rapidly reacting to a positional change of the recording medium during image formation and which prevents occurrence of wrinkles in the recording medium.

An image formation device according to an aspect of the invention includes a transport section that applies a tension to a recording medium while transporting the recording medium in a transport direction, a width-direction positional change section that changes a position of the recording medium in a width direction that intersects the transport direction, a detector that detects a position of an edge of the recording medium in the width direction within a detection area, a control section that performs width-direction positional control by operating the width-direction positional change section in accordance with a detection result of the detector and by performing feedback control on the position of the recording medium in the width direction, and an image formation section that is located so as to face the recording medium and performs image formation on the recording medium. In the image formation device, the control section performs control, during the image formation, in a first control mode where the width-direction positional control is performed with a first frequency response characteristic corresponding to a frequency band including a high frequency band or in a second control mode where the width-direction positional control is performed with a second frequency response characteristic corresponding to a frequency band lower than the high frequency band.

According to another aspect of the invention, a method of transport control for transporting a recording medium in a transport direction includes detecting a position of an edge of the recording medium in a width direction that intersects the transport direction, and performing width-direction positional control where a position of the recording medium is subjected to feedback control in the width direction in accordance with a detection result of the position of the edge of the recording medium, while switching a first control mode and a second control mode. The first control mode is a mode where the width-direction positional control is performed with a first frequency response characteristic corresponding to a frequency band including a high frequency band during the image formation, and the second control mode is a mode where the width-direction positional control is performed with a second frequency response characteristic corresponding to a frequency band lower than the high frequency band.

As described above, in the invention (entitled "IMAGE FORMATION DEVICE AND TRANSPORT CONTROL METHOD FOR RECORDING MEDIUM"), the width-direction positional control is performed where the position of the recording medium is subjected to feedback control in accordance with a detection result of the position of the edge of the recording medium. In addition, since the width-direction positional control is performed with the first frequency response characteristic corresponding to a frequency band including a high frequency band (the first control mode) during image formation on the recording medium, the positional change of the recording medium can be rapidly reacted to, and thus image formation can be favorably performed. In addition to the first control mode, in the invention, the second control mode can be employed where the width-direction positional control can be performed with the second frequency response characteristic corresponding to a relatively low frequency band, which is lower than the high frequency band. In the second control mode, if a sharp signal which is not used in the image formation is input to the control system (a control section), an abrupt positional change of the recording medium made by the control system can be prevented, whereby occurrence of wrinkles in the recording medium can be prevented. As a result, in the invention, favorable image formation can be realized by rapidly reacting to a positional change of the recording medium during image formation, and also occurrence of wrinkles in the recording medium can be prevented.

The invention is particularly preferable for an image formation device in which a recording medium having a step portion at which the position of the edge changes in the width direction is transported in the transport direction. In other words, in the image formation device, a recording medium formed by jointing recording media having different widths may be used for image formation. In such a case, the recording medium has a step portion at which the position of the edge changes in the width direction. When the step portion passes through the detection area as the recording medium is transported, a sharp signal corresponding to the step portion of the recording medium is input to the control section, which likely causes the recording medium to become wrinkled as described above. According to an aspect of the invention, occurrence of wrinkles in the recording medium is preferably prevented.

Specifically, the image formation device may have a configuration in which the control section operates in the second control mode when the step portion of the recording medium passes through a detection area in the transport direction. In such a manner, even if a sharp signal is input to the control section as a result of detection of the step portion of the recording medium, an abrupt positional change of the recording medium made by the control section can be prevented, whereby occurrence of wrinkles in the recording medium can be prevented.

Further, the image formation device may have a configuration in which the control section performs the width-direction positional control by performing feedback control such that the position of the edge of the recording medium detected by the detector approaches a target position.

In such a case, the image formation device may have a configuration in which the control section may perform a target position change process for adjusting, in the width direction, the position of the recording medium transported toward the image formation section by changing the target position in the width direction in accordance with a difference of the position of the edge of the recording medium on an upstream side and a downstream side of the transport direction across the step portion. By changing the target position for the edge of the recording medium in the width direction in accordance with the difference in the widths of the recording medium across the step portion, the position of the recording medium transported toward the image formation section can be appropriately adjusted in the width direction.

Note that since a change of the target position is substantially an input of a sharp signal to the control section, wrinkles in the recording medium may be caused as described above. To avoid this problem, the image formation device may have a configuration in which the control section performs the second control mode during the target position change process. In such a manner, even if a sharp signal is input to the control section as a result of change of the target position for the edge of the recording medium, an abrupt positional change of the recording medium made by the control section can be prevented, whereby occurrence of wrinkles in the recording medium can be prevented.

The image formation device may have a configuration in which the detection area of the detector is movable in the width direction. In such a case, however, since a positional change of the detection area is substantially an input of a sharp signal to the control section, wrinkles in the recording medium may be caused as described above. To avoid this problem, the image formation device may have a configuration in which the control section performs the second control mode when the detection area is changed in the width direction. In such a manner, even if a sharp signal is input to the control section as a result of the positional change of the detection area, an abrupt positional change of the recording medium made by the control section can be prevented, whereby occurrence of wrinkles in the recording medium can be prevented.

Further, the image formation device may have a configuration in which after the second control mode, the control section changes the frequency response characteristic of the width-direction positional control to the first frequency response characteristic. By changing the frequency response characteristic from the second frequency response characteristic to the first frequency response characteristic in advance, the control mode can be promptly switched to the first control mode after the second control mode and the image formation can be started smoothly.

Specifically, the image formation device may further include a take-up roller that takes up the recording medium on a downstream side in the transport direction from the image formation section. The control section may change the frequency response characteristic of the width-direction positional control to the first frequency response characteristic after the second control mode and after the step portion of the recording medium is wrapped by the take-up roller.

Further, the image formation device may further include a setting input section with which an operator sets a timing at which to perform the second control mode, and the control section performs the second control mode at the timing set in the setting input section. This enables, for example, the second control mode to be performed at any timing decided upon by the operator.

The image formation device may have a configuration in which the control section changes the frequency response characteristic of the width-direction positional control between the first frequency response characteristic and the second frequency response characteristic by changing a feedback gain of feedback control in the width direction position control. By changing the feedback gain, the frequency response characteristic of the width-direction positional control can be changed easily.

The image formation device may have a configuration in which the control section makes a tension of the recording medium in the second control mode lower than a tension of the recording medium in the first control mode by controlling the transport section.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
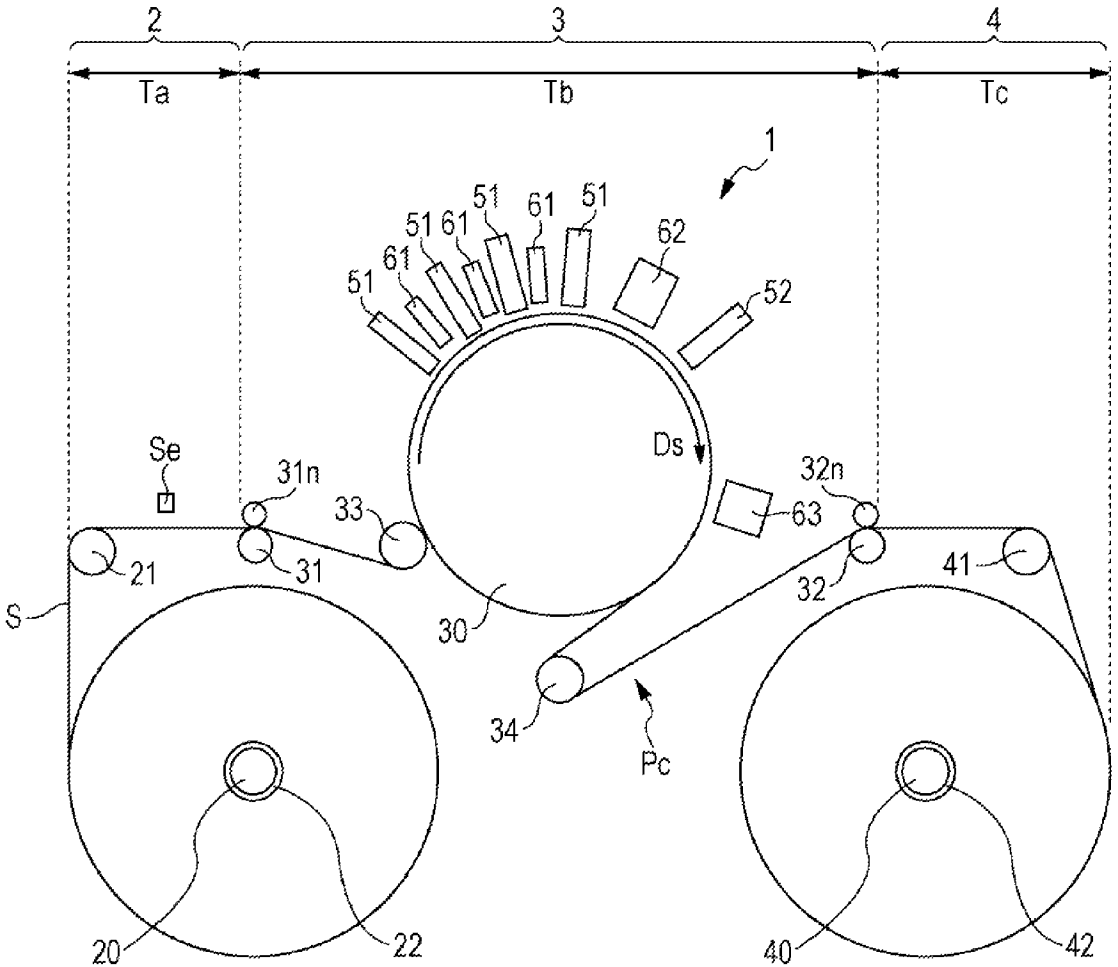
FIG. 1 is a front view illustrating a device configuration of a printer to which the invention can be applied.

FIG. 1 is a front view schematically illustrating an example of a device configuration of a printer to which the invention can be applied. As illustrated in FIG. 1, in a printer 1, a single sheet S (a web) two ends of which are wrapped around a supply spindle 20 and a take-up spindle 40 is stretched between the supply spindle 20 and the take-up spindle 40. The stretched sheet S is transported from the supply spindle 20 to the take-up spindle 40 along a transport path Pc. In the printer 1, an image is recorded on the sheet S transported along the transport path Pc. The sheets S are roughly classified as paper-based sheets and film-based sheets. As specific examples, paper-based sheets include high-quality paper, cast paper, art paper, and coated paper, while film-based sheets include synthetic paper, polyethylene terephthalate (PET), and polypropylene (PP). In brief, the printer 1 includes a supply section 2 (a supply region) for supplying the sheet S from the supply spindle 20, a process section 3 (a process region) for recording an image on the sheet S supplied from the supply section 2, and a take-up section 4 (a take-up region) for wrapping the sheet S on which the image has been recorded by the process section 3, around the take-up spindle 40. In the following description, one side of the sheet S on which an image is recorded is referred to as a "front surface", while the side opposite thereto is referred to as a "back surface".

The supply section 2 includes the supply spindle 20, around which an end of the sheet S is wrapped, and a driven roller 21 around which the sheet S having been drawn out from the supply spindle 20 is wound. The supply spindle 20 supports the end of the sheet S wrapped therearound with the front surface of the sheet S facing outward. As the supply spindle 20 rotates in the clockwise direction in FIG. 1, the sheet S wrapped around the supply spindle 20 is drawn out to the process section 3 via the driven roller 21. The sheet S is wrapped around the supply spindle 20 with a core tube 22, which is detachably mounted on the supply spindle 20. When the sheet S wrapped around the supply spindle 20 ends, another sheet S can be provided by mounting another core tube 22 around which another sheet S has been wrapped, on the supply spindle 20.

In the process section 3, the sheet S from the supply section 2 is supported by a platen drum 30, and an image is recorded on the sheet S by an appropriate process using functional sections 51, 52, 61, 62, and 63, which are provided along the outer peripheral surface of the platen drum 30. In the process section 3, a front drive roller 31 and a rear drive roller 32 are provided so that the platen drum 30 is interposed therebetween, and the sheet S, which is transported from the front drive roller 31 to the rear drive roller 32, is supported by the platen drum 30 and is subjected to image recording.

The front drive roller 31 has a plurality of minute projections formed by thermal spraying on its outer peripheral surface, and winds the sheet S supplied from the supply section 2 from the back surface side. As the front drive roller 31 rotates in the clockwise direction in FIG. 1, the sheet S supplied from the supply section 2 is transported toward a downstream side along the transport path. A nip roller 31*n* is provided to the front drive roller 31. The nip roller 31*n* is urged toward the front drive roller 31 and abuts against the front surface of the sheet S. Thus, the front drive roller 31 and the nip roller 31*n* pinch the sheet S therebetween. This ensures friction between the front drive roller 31 and the sheet S, and makes the front drive roller 31 reliably transport the sheet S.

The platen drum 30 is a cylindrically-shaped drum rotatably supported by a support mechanism (not shown). The platen drum 30 has a diameter of, for example, 400 mm. The sheet S transported from the front drive roller 31 to the rear drive roller 32 is wound around the platen drum 30 from the back surface side. The platen drum 30 supports the sheet S from the back surface side while being rotated in the transport direction Ds of the sheet S under the friction with the sheet S. In the process section 3, driven rollers 33 and 34 for turning the sheet S are provided on opposite sides of the platen drum 30 around which the sheet S is wound. The driven roller 33 turns the sheet S between the front drive roller 31 and the platen drum 30, with the front surface of the sheet S facing the driven roller 33. On the other hand, the driven roller 34 turns the sheet S between the platen drum 30 and the rear drive roller 32, with the front surface of the sheet S facing the drive roller 34. In this manner, the sheet S is turned on both the upstream and downstream sides of the platen drum 30 in the transport direction Ds, whereby it can be ensured that the length of a portion of the sheet S which is wound around the platen drum 30 is long.

The rear drive roller 32 has a plurality of minute projections formed by thermal spraying on its outer peripheral surface, and winds the sheet S transported from the platen drum 30 via the driven roller 34 from the back surface side. As the rear drive roller 32 rotates in the clockwise direction in FIG. 1, the sheet S is transported toward the take-up section 4. A nip roller 32*n* is provided to the rear drive roller 32. The nip roller 32*n* is urged toward the rear drive roller 32 and abuts against the front surface of the sheet S. Thus, the rear drive roller 32 and the nip roller 32*n* pinch the sheet S therebetween. This ensures friction between the rear drive roller 32 and the sheet S, and makes the rear drive roller 32 reliably transport the sheet S.

In this manner, the sheet S transported from the front drive roller 31 to the rear drive roller 32 is supported by the outer peripheral surface of the platen drum 30. In the process section 3, in order to record a color image on the front surface of the sheet S supported by the platen drum 30, a plurality of recording heads 51 corresponding to different colors are provided. Specifically, four recording heads 51 each corresponding to yellow, cyan, magenta, or black are lined up in this order in the transport direction Ds. Each of the recording heads 51 faces the front surface of the sheet S wound around the platen drum 30, with a small gap therebetween, and ejects ink of the corresponding color (colored ink) from a nozzle in an ink jet method. Each of the recording heads 51 ejects ink toward the sheet S transported in the transport direction Ds, whereby a color image is formed on the front surface of the sheet S.

Ultraviolet (UV) ink which is cured by being irradiated with ultraviolet rays (light) (i.e., photo-curable ink) is used as the ink. UV radiation devices 61 and 62 (a light radiation section) are therefore provided in the process section 3 in order to cure the ink and fix the ink to the sheet S. The ink is cured by two stages: pre-curing and main curing. The UV radiation devices 61 for pre-curing are each provided between the recording heads 51. The UV radiation device 61 irradiates the ink with weak ultraviolet rays and cures the ink to such an extent that the ink does not lose its shape (pre-curing). That is, the UV radiation device 61 does not fully cure the ink. On the other hand, the UV radiation device 62 for main curing is provided downstream in the transport direction Ds for the recording heads 51. The UV radiation device 62 irradiates the ink with stronger ultraviolet rays than the UV radiation device 61 and fully cures the ink (main curing).

As described above, the UV radiation device 61 provided between the recording heads 51 pre-cures the colored ink ejected toward the sheet S from the recording head 51 provided upstream in the transport direction Ds. In other words, the ink ejected toward the sheet S by one of the recording heads 51 is pre-cured before reaching the next recording head 51 provided downstream in the transport direction Ds. In such a manner, mixing of the colored inks having differed colors can be prevented. While color mixing is thus prevented, the recording heads 51 eject the colored inks having different colors to form a color image on the sheet S. In addition, the UV radiation device 62 for main curing is provided downstream in the transport direction Ds from the plurality of recording heads 51. The color image formed by the recording heads 51 is subjected to main curing by the UV radiation device 62 and is fixed to the sheet S.

Further, the recording head 52 is provided downstream in the transport direction Ds from the UV radiation device 62. The recording head 52 faces the front surface of the sheet S wound around the platen drum 30 with a small gap therebetween, and ejects transparent UV ink toward the front surface of the sheet S from a nozzle in an ink jet method. In other words, the transparent ink is further ejected onto the color image formed by the recording heads 51 corresponding to four colors. This transparent ink is ejected onto the entire area of the color image to give a texture such as gloss or matte. In addition, the UV radiation device 63 is provided downstream in the transport direction Ds from the recording head 52. The UV radiation device 63 emits strong ultraviolet rays to fully cure the transparent ink ejected by the recording head 52 (main curing), whereby the transparent ink can be fixed to the front surface of the sheet S.

As described thus far, in the process section 3, ink is ejected and cured as appropriate on the sheet S wound around the periphery of the platen drum 30, and a color image coated with the transparent ink is formed. The sheet S on which the color image is formed is then transported toward the take-up section 4 by the rear drive roller 32.

The take-up section 4 includes, in addition to the take-up spindle 40 around which the end of the sheet S is wrapped, a driven roller 41 around which the sheet S is wound from the back surface side between the take-up spindle 40 and the rear drive roller 32. The take-up spindle 40 supports the sheet S by taking up the end thereof from the back surface side of the sheet S. As the take-up spindle 40 rotates in the clockwise direction in FIG. 1, the sheet S transported from the rear drive roller 32, passes over the driven roller 41 and is wrapped around the take-up spindle 40. The sheet S is wrapped around the take-up spindle 40 with a core tube 42, which is detachably mounted on the take-up spindle 40. When the take-up spindle 40 is filled to capacity with the sheet S, the sheet S can be detached together with the core tube 42.

In the above-described structure where an image is formed by the recording heads 51 and 52 on the sheet S transported by the platen drum 30, if the sheet S (or the edges thereof) is slanted with respect to the transport direction Ds and is transported to the platen drum 30, the formed image is also slanted with respect to the sheet S, resulting in unfavorable image formation. Therefore, the printer 1 includes a steering mechanism 2*s* (see FIG. 2) in the supply section 2.

Figure 2:
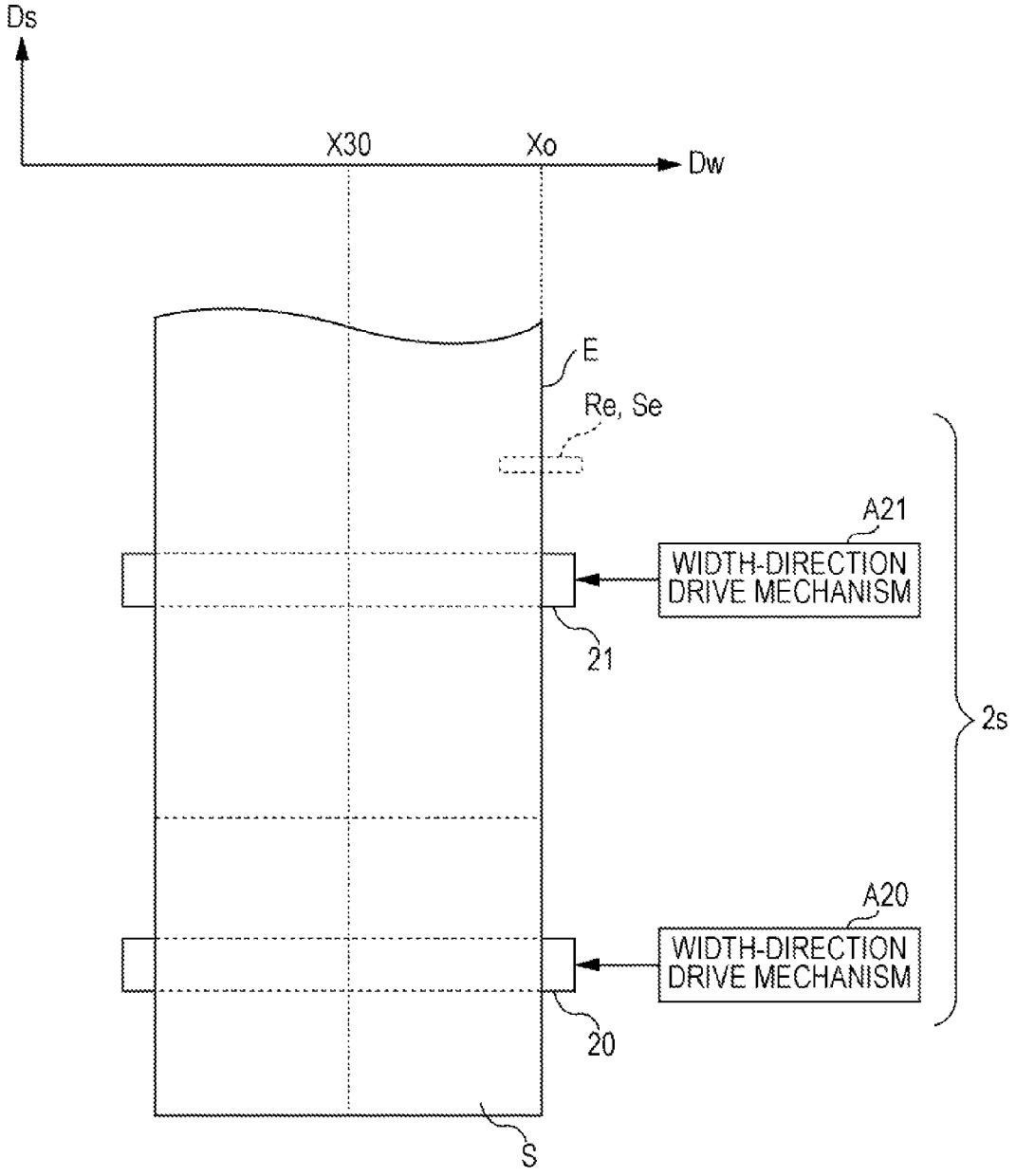
FIG. 2 schematically illustrates an example of a steering mechanism provided in a supply section.

FIG. 2 schematically illustrates an example of the steering mechanism provided in the supply section. FIG. 2 is a developed drawing of the steering mechanism 2*s* extending in the transport direction Ds. The steering mechanism 2*s* includes width-direction drive mechanisms A20 and A21 and an edge sensor Se (see FIG. 1), as well as the above-described supply spindle 20 and driven roller 21. In FIG. 2, a detection area Re of the edge sensor Se is illustrated instead of the edge sensor Se. This steering mechanism 2*s* performs width-direction movement control (steering control) in which the position of the sheet S is adjusted in a width direction Dw, which intersects the transport direction Ds (the width direction Dw is perpendicular to the plane of the paper in FIG. 1).

The width-direction drive mechanism A20 moves the supply spindle 20 in the width direction Dw (the direction along the spindle) with the driving force of a motor, and thereby moves the sheet S in the width direction Dw by moving a portion of the sheet S which is wound around the supply spindle 20. Further, the width-direction drive mechanism A21 moves the driven roller 21 in the width direction Dw (the direction along the spindle) with the driving force of a motor, and thereby moves the sheet S in the width direction Dw by moving a portion of the sheet S which is wound around the driven roller 21. The steering mechanism 2*s* makes the width-direction drive mechanisms A20 and A21 cooperate with each other, and adjusts the position of the sheet S in the width direction Dw by moving the portions of the sheet S which are wound around the width-direction drive mechanisms A20 and A21, whereby the sheet S is transported toward the platen drum 30 in a state of being parallel to the transport direction Ds.

The edge sensor Se is provided downstream in the transport direction Ds from the driven roller 21 (i.e., between the driven roller 21 and the front drive roller 31 in FIG. 1), so as to face an edge E of the sheet S in the width direction Dw. This edge sensor Se has the detection area Re with a predetermined width in the width direction Dw, and detects the position in the width direction Dw of the edge E of the sheet S within the detection area Re. Specifically, the edge sensor Se can include a distance sensor which measures the distance with a target in the detection area Re. The edge sensor Se is movable in the width direction Dw; for example, an operator can move the edge sensor Se in the width direction Dw to move the detection area Re of the edge sensor Se in the width direction Dw and thus optimize a positional relationship between the edge E of the sheet S and the detection area Re.

The steering mechanism 2*s*, as will be described below, performs feedback control on the width-direction drive mechanisms A20 and A21 and adjusts the edge E of the sheet S in the width direction Dw to be in the target position Xo, in accordance with a detection result of the edge E of the sheet S by the edge sensor Se. In such a manner, the sheet S is transported toward the platen drum 30 in a state of being parallel to the transport direction Ds. The target position Xo is basically set so that a position X30 of the central line of the platen drum 30 coincides with the central line of the sheet S in the width direction Dw.

Figure 3:
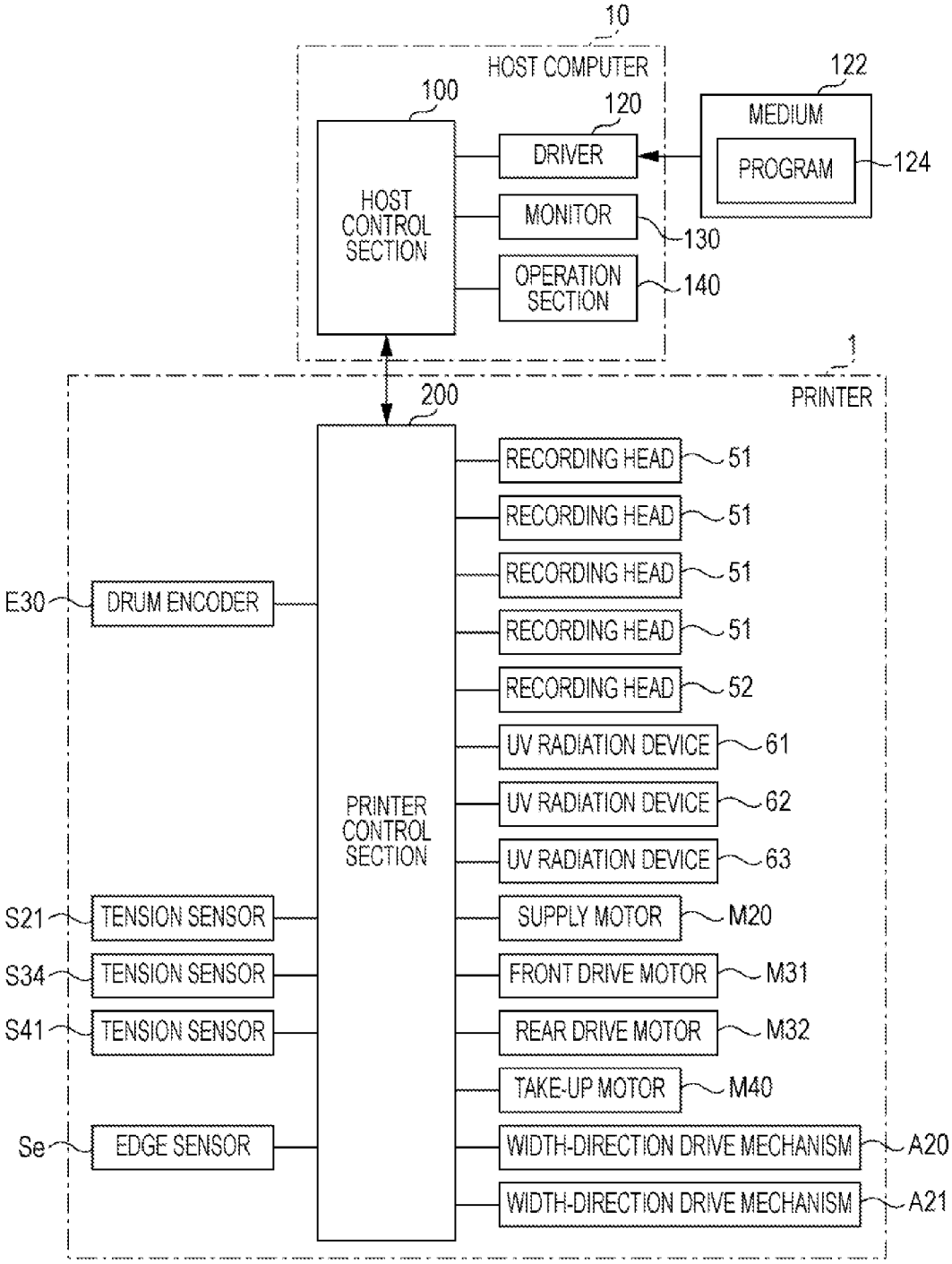
FIG. 3 is a block diagram schematically illustrating an electrical configuration for controlling the printer illustrated in FIG. 1.

A summary of the device configuration of the printer 1 has been described so far. Next, an electrical configuration for controlling the printer 1 will be described. FIG. 3 is a block diagram schematically illustrating an electrical configuration for controlling the printer in FIG. 1. The operation of the printer 1 described above is controlled by a host computer 10 in FIG. 3. In the host computer 10, a host control section 100 for generally controlling operations includes a central processing unit (CPU) and a memory. A driver 120 is also provided in the host computer 10. The driver 120 reads out a program 124 from a medium 122. The medium 122 can be any of a variety of media such as a compact disk (CD), a digital versatile disk (DVD), or a universal serial bus (USB) memory. The host control section 100 controls the sections of the host computer 10 and the operation of the printer 1, on the basis of the program 124 read out from the medium 122.

The host computer 10 also includes a monitor 130 including a liquid crystal display or the like and an operation section 140 including a keyboard, a mouse, or the like as an interface with an operator. On the monitor 130, in addition to an image to be printed, a menu window is also displayed. The operator who operates the operation section 140 while also checking the monitor 130, can open a print setting window from the menu window and set printing conditions such as the type and the size of the print medium or the quality of printing. A specific configuration of the interface for the operator can be variously modified; for example, a touch screen can be used as the monitor 130 and be also used as the operation section 140.

In the printer 1, a printer control section 200 for controlling the sections of the printer 1 in accordance with a command from the host computer 10 is also provided. The recording heads, the UV radiation devices, and the sections in a sheet transport system are controlled by the printer control section 200. The control performed by the printer control section 200 over these sections is described below in detail.

The printer control section 200 controls an ink ejection timing for each of the recording heads 51 forming a color image, in accordance with the transport of the sheet S. Specifically, the ink ejection timing is controlled on the basis of an output (a detection value) from a drum encoder E30 which is mounted on a rotating spindle of the platen drum 30 and which detects the rotational position of the platen drum 30. Since the platen drum 30 rotates in association with the transport of the sheet S, the position of the transported sheet S can be ascertained with reference to the output from the drum encoder E30 which detects the rotational position of the platen drum 30. Thus, the printer control section 200 generates a print timing signal (pts) from the output from the drum encoder E30 and controls the ink ejection timing of each of the recording heads 51 on the basis of the pts, whereby the ink ejected by each of the recording heads 51 is delivered to target positions on the sheet S being transported to form a color image.

An ejection timing of the transparent ink from the recording head 52 is similarly controlled by the printer control section 200 on the basis of the output from the drum encoder E30. The transparent ink can be thus accurately ejected onto the color image formed by the recording heads 51. In addition, the timing of turning on and off of the UV radiation devices 61, 62, and 63 and the intensity of the irradiation light from the UV radiation devices 61, 62, and 63 are also controlled by the printer control section 200.

The printer control section 200 also controls the transport of the sheet S, which is described in detail with reference to FIG. 1. Specifically, among the members constituting the sheet transport system, each of the supply spindle 20, the front drive roller 31, the rear drive roller 32, and the take-up spindle 40 is connected to a motor. The printer control section 200 controls the speed and torque of each motor while rotating the motors, and thus controls the transport of the sheet S. The transport control of the sheet S is described below in detail.

The printer control section 200 makes a supply motor M20 for driving the supply spindle 20 rotate, and feeds the sheet S from the supply spindle 20 to the front drive roller 31. The printer control section 200 also controls the torque of the supply motor M20 to adjust a tension (a supply tension Ta) of the sheet S between the supply spindle 20 and the front drive roller 31. A tension sensor S21 for detecting the supply tension Ta is mounted on the driven roller 21 between the supply spindle 20 and the front drive roller 31. The tension sensor S21 can include, for example, a load cell which detects the force received from the sheet S. The printer control section 200 performs feedback control on the torque of the supply motor M20 in accordance with a detection result of the tension sensor S21 to adjust the supply tension Ta of the sheet S.

The printer control section 200 also rotates a front drive motor M31 for driving the front drive roller 31, and a rear drive motor M32 for driving the rear drive roller 32. Thus, the sheet S supplied from the supply unit 2 is passed through the process section 3, while the speed of the front drive motor M31 and the torque of the rear drive motor M32 are controlled. In other words, the printer control section 200 adjusts the rotational speed of the front drive motor M31 to be constant, on the basis of an encoder output from the front drive motor M31. The sheet S is thus transported at a constant speed by the front drive roller 31.

The printer control section 200 also controls the torque of the rear drive motor M32 to adjust a tension (a process tension Tb) of the sheet S between the front drive roller 31 and the rear drive roller 32. A tension sensor S34 which detects the process tension Tb is mounted on the drive roller 34 between the platen drum 30 and the rear drive roller 32. This tension sensor S34 can include, for example, a load cell which detects the force received from the sheet S. The printer control unit 200 also performs feedback control on the torque of the rear drive motor M32 in accordance with a detection result of the tension sensor S34 to adjust the process tension Tb of the sheet S.

The printer control section 200 also rotates a take-up motor M40 which drives the take-up spindle 40, so that the sheet S transported by the rear drive roller 32 is wrapped around the take-up spindle 40. The printer control section 200 also controls the torque of the take-up motor M40 to adjust a tension (a take-up tension Tc) of the sheet S between the rear drive roller 32 and the take-up spindle 40. A tension sensor S41 which detects the take-up tension Tc is mounted on the driven roller 41 between the rear drive roller 32 and the take-up spindle 40. This tension sensor S41 can include, for example, a load cell which detects the force received from the sheet S. The printer control section 200 performs feedback control on the torque of the take-up motor M40 in accordance with a detection result of the tension sensor S41 to adjust the take-up tension Tc of the sheet S.

Further, the printer control section 200 controls the above-described steering mechanism 2*s*. The printer control section 200 performs feedback control on the width-direction drive mechanisms A20 and A21 in accordance with a detection result of the edge sensor Se. Specifically, the printer control section 200 performs width-direction movement control (steering control) using a steering control block 210 and a memory section 220 in the printer control section 200, as illustrated in FIG. 4.

Figure 4:
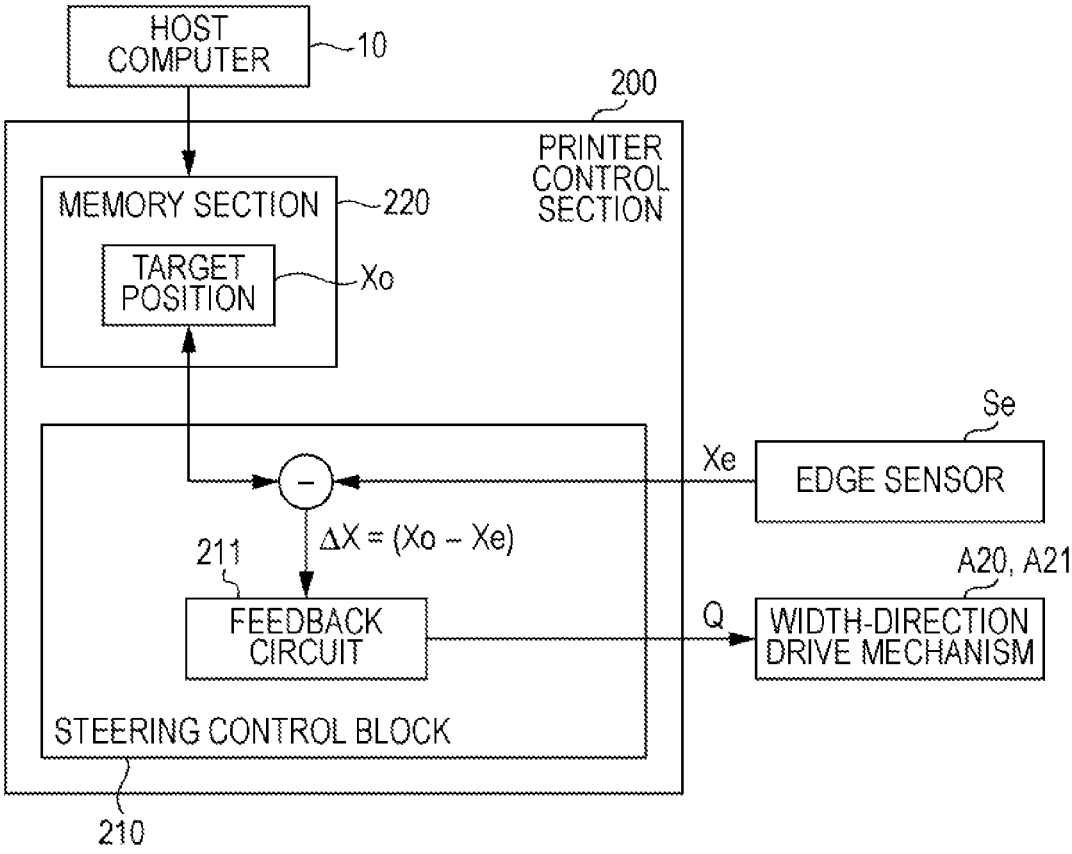
FIG. 4 is a block diagram exemplifying an outline of an electrical configuration for performing width-direction movement control.

FIG. 4 is a block diagram exemplifying an outline of an electrical configuration for performing width-direction movement control. The steering control block 210 in the printer control section 200 calculates a deviation $\Delta X$ ($=Xo-Xe$) between a position Xe of the edge E of the sheet S in the width direction Dw which is detected by the edge sensor Se (i.e., a detection result) and the target position Xo stored in the memory section 220, and inputs the deviation to the feedback circuit 211 in the steering control block 210. The feedback circuit 211 supplies an amount of operation Q obtained by multiplying the deviation by a feedback gain K ($Q=K\times\Delta X$) to the width-direction drive mechanisms A20 and A21. Then, each of the width-direction drive mechanisms A20 and A21 changes the position in the width direction Dw by the amount corresponding to the amount of operation Q in such a manner that the deviation $\Delta X$ converges to zero (i.e., that the detection position Xe approaches the target position Xo).

The memory section 220 in the printer control section 200 includes a memory and stores the target position Xo. In order to set the target position Xo in the memory section 220, the operator may operate the operation section 140 so that the position is stored via the host control section 100, or the steering control block 210 may access the memory section 220.

In the printer control section 200 having such a configuration, the feedback circuit 211 performs feedback control on the width-direction drive mechanisms A20 and A21, in accordance with the detection result of the edge sensor Se, whereby the width-direction movement control is performed. Here, the frequency response characteristic of the feedback control performed by the feedback circuit 211 can be switched between a first frequency response characteristic corresponding to a high frequency band and a second frequency response characteristic corresponding to a low frequency band.

Figure 5:
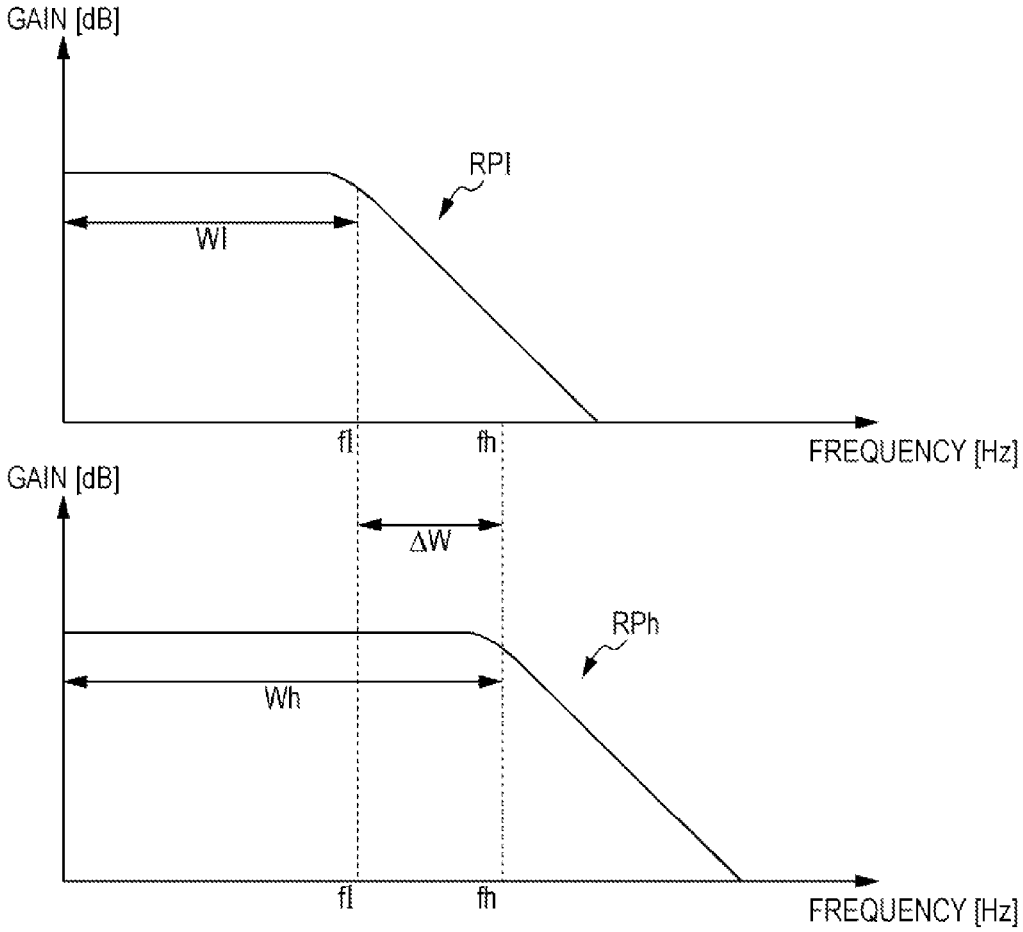
FIG. 5 illustrates a frequency response characteristic of feedback control in the width-direction movement control.

FIG. 5 is a Bode plot of the frequency response characteristic of feedback control in the width-direction movement control. The first frequency response characteristic RPh has a relatively high cut-off frequency fh and reacts to a frequency band Wh equal to or lower than the cut-off frequency fh. The second frequency response characteristic RP1 has a cut-off frequency fl lower than the cut-off frequency fh (fl<fh) and reacts to a frequency band W1 equal to or lower than the cut-off frequency fl, but does not react to a high frequency band ΔW higher than the cut-off frequency fl (the high frequency band is between the cut-off frequency fl and the cut-off frequency fh).

With such a structure, when the feedback circuit 211 performs the width-direction movement control with the first frequency response characteristic RPh, the feedback circuit 211 reacts to an input deviation ΔX with a sharp change faster than the cut-off frequency fl, and moves the sheet S in the width direction Dw. On the other hands, when the feedback circuit 211 performs the width-direction movement control with the second frequency response characteristic RP1, the feedback circuit 211 does not react to the input deviation ΔX with a sharp change faster than the cut-off frequency fl; the sheet S is not immediately moved in the width direction Dw but is moved slowly in accordance with the cut-off frequency fl.

The first frequency response characteristic RPh and the second frequency response characteristic RP1 are switched by changing the feedback gain K of the feedback circuit 211. By changing the feedback gain K, the frequency response characteristic of the width-direction positional control can be changed easily.

The feedback circuit 211 performs the width-direction movement control with the first frequency response characteristic RPh (a first control mode) when an image is formed on the sheet S by the recording heads 51 and 52. Thus, the feedback circuit 211 reacts rapidly to the positional change of the sheet S, and image formation can be favorably performed. On the other hand, when an image is not formed, the feedback circuit 211 appropriately performs the width-direction movement control with the second frequency response characteristic RP1 (a second control mode). Note that both of the first control mode and the second control mode are performed while the sheet S is transported in the transport direction Ds. The transport speed of the sheet S may be either the same or different between the first control mode and the second control mode.

The second control mode may be performed at variety of circumstances. In particular, when an image is formed on a single sheet S which is formed by jointing a plurality of sheets with different widths, the second control mode is preferably performed in some timings. The following description is given to explain the specific timings of performing the second control mode in the printer 1 forming an image on such a sheet S.

Figure 6:
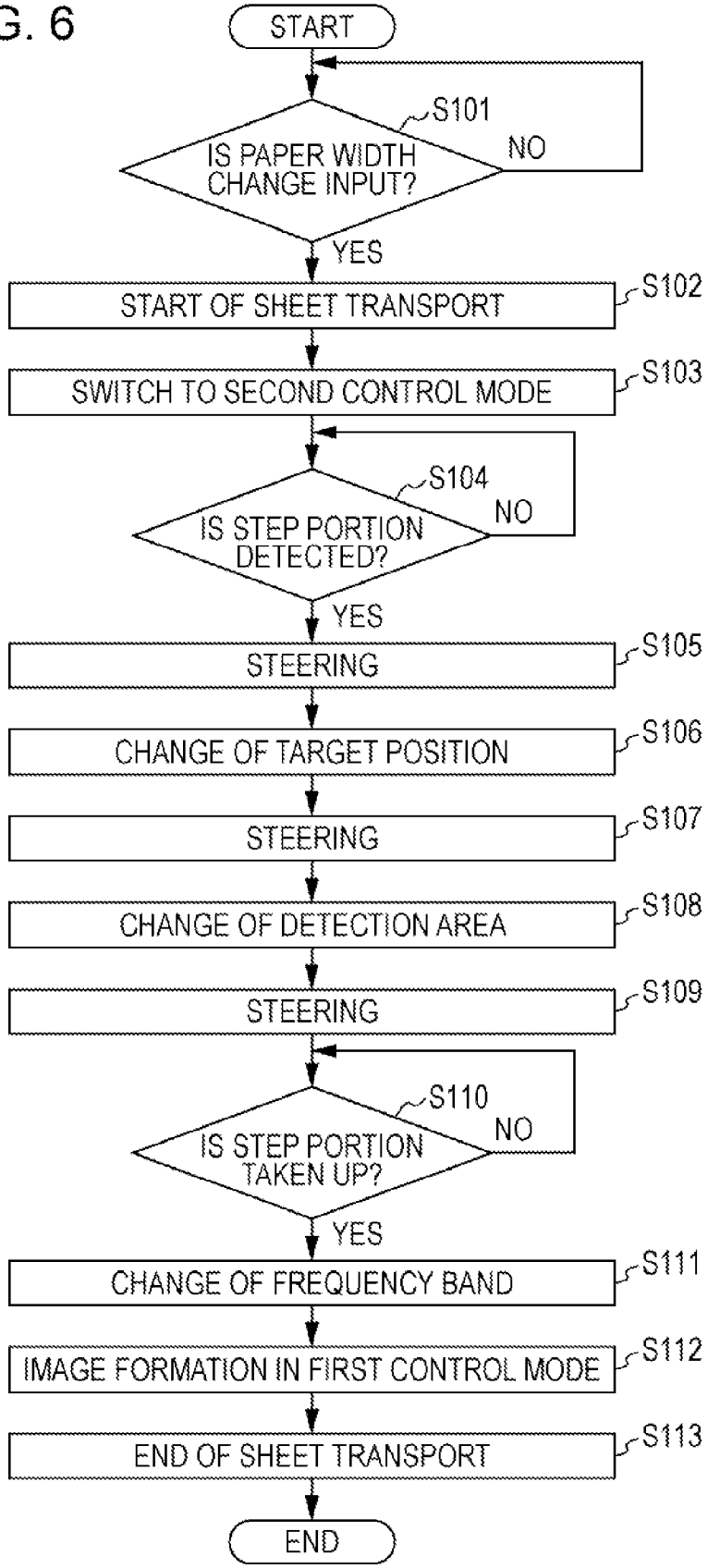
FIG. 6 is a flow chart illustrating an example of an operation performed in the printer illustrated in FIG. 1.
Figure 7:
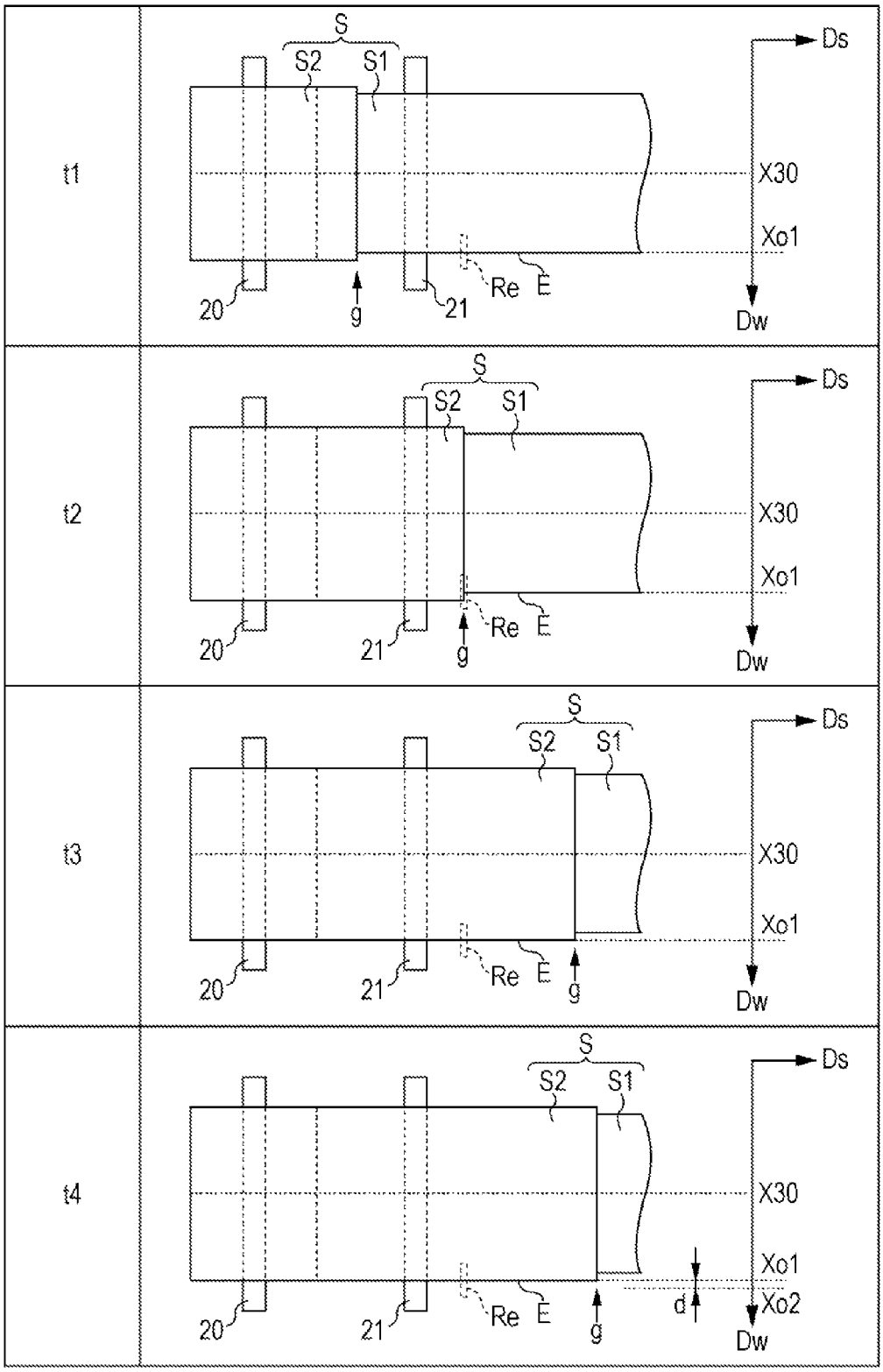
FIG. 7 illustrates an operation of a steering mechanism.

FIG. 6 is a flow chart illustrating an example of an operation performed in the printer illustrated in FIG. 1. FIG. 7 schematically illustrates an example of an operation of a steering mechanism according to the flow chart of FIG. 6. FIG. 7 illustrates developed drawings of the steering mechanism 2*s* extending in the transport direction Ds. As illustrated in FIG. 7, in the case where the single sheet S is formed by jointing media S1 and S2 with different widths, a step portion g, which is a positional change of the edge E of the sheet S in the width direction Dw, is made at the joint of the sheets S1 and S2. Across the step portion g, the width of the sheet S1 on a downstream side of the transport direction Ds and the width of the sheet S2 on an upstream side in the transport direction Ds are different from each other; accordingly, the positional control over the edge E of the sheet S needs to be changed for transporting the sheet S1 toward the platen drum 30 from that for transporting the sheet S2 toward the platen drum 30. For example, in the case where an image is formed on the sheet S2 after an image is formed on the sheet S1, the operator inputs the change of the paper width of the sheet S from the paper width of the sheet S1 to that of the sheet S2, to the printer control section 200 via the operation section 140 (Step S101).

If the operator inputs the change (YES in Step S101), the printer control section 200 controls the motors M20, M31, M32, and M40 to start the transport of the sheet S in the transport direction Ds while applying a determined tension to the sheet S (Step S102). In Step S103, the control mode of the feedback circuit 211 for the width-direction positional control, which has been the first control mode during image formation on the sheet S1 is switched to the second control mode. As illustrated in the row of "t1" in FIG. 7, at a time t1 when the mode is switched to the second control mode, the step portion g of the sheet S is on an upstream side in the transport direction Ds from the detection area Re, and the edge sensor Se detects the edge E of the sheet S1.

Then, as illustrated in the row of "t2" in FIG. 7, at a time t2 (t2>t1) when the step portion g moved together with the sheet S in the transport direction Ds reaches the detection area Re, the step portion g is detected by the edge sensor Se and the deviation ΔX with a sharp change is input to the feedback circuit 211. Since the control mode of the feedback circuit 211 is the second control mode, the feedback circuit 211 does not immediately react to the input deviation ΔX with a sharp change; the feedback circuit 211 slowly reacts to the deviation ΔX, in accordance with the cut-off frequency fl. Accordingly, in Step S105, steering is performed by slowly moving the sheet S in the width direction Dw. Thus, as illustrated in the row of "t3" in FIG. 7, at a time t3 (t3>t2), the edge E of the sheet S2 in the sheet S coincides with a target position Xo1. Note that at the time t3, the step portion g of the sheet S has passed through the detection area Re and is on a downstream side in the transport direction Ds from the detection area Re; accordingly, the edge sensor Se detects the edge E of the sheet S2.

The target position Xo1 is a target position set in accordance with the width of the sheet S1 which is subjected to image formation before the sheet S2. Therefore, if the edge E of the sheet S2 is adjusted to the target position Xo1, the central position of the sheet S deviates from the position X30, which is the center of the platen drum 30, in the width direction Dw. In order to correct this, in Step S106, the target position Xo is changed from the target position Xo1 to a target position Xo2 (a target position change process) by an operator changing the setting via the operation section 140 or by the steering control block 210 accessing the memory section 220. The target position Xo2 is a target position set in accordance with the width of the sheet S2. In such manner, as illustrated in the row "t4" in FIG. 7, at a time t4 (t4>t3), the position of the edge E of the sheet S2 is deviated from the new target position Xo2 by a distance d in the width direction Dw.

Therefore, at the time t4 in which the target position Xo is changed, the deviation ΔX with a sharp change is substantially input to the feedback circuit 211. However, since the control mode of the feedback circuit 211 is the second control mode, the feedback circuit 211 does not immediately react to the input deviation ΔX with a sharp change; the feedback circuit 211 slowly reacts to the deviation ΔX, in accordance with the cut-off frequency fl. Accordingly, in Step S107, steering is performed by slowly moving the sheet S in the width direction Dw, whereby the edge E of the sheet S2 in the sheet S coincides with the target position Xo2.

Note that as a result of the steering in Step S107, the positional relationship between the edge E of the sheet S2 and the detection area Re changes in the width direction Dw. In Step S108, therefore, for example, the operator moves the edge sensor Se to change the position of the detection area Re, and thus optimizes the positional relationship between the edge E of the sheet S2 and the detection area Re in the width direction Dw. When the position of the detection area Re is changed, the positional relationship between the detection area Re and the edge E of the sheet S changes, and the deviation ΔX with a sharp change is substantially input to the feedback circuit 211. Since the control mode of the feedback circuit 211 is the second control mode, the feedback circuit 211 does not immediately react to the input deviation ΔX with a sharp change; the feedback circuit 211 slowly reacts to the deviation ΔX, in accordance with the cut-off frequency fl. Accordingly, in Step S109, steering is performed by slowly moving the sheet S in the width direction Dw.

Then, after the step portion g is wrapped by the take-up spindle 40 in Step S110 (that is, when the step portion g is included in a roll supported by the take-up spindle 40), the feedback gain K of the feedback circuit 211 is changed (is risen up) in Step S111, and the frequency band of the feedback circuit 211 is changed from the frequency band W1 to the frequency band Wh. Note that whether the step portion g is wrapped by the take-up spindle 40 or not can be judged by, for example, whether the time corresponding to a period of time obtained by dividing the length of the sheet S between the edge sensor Se and the take-up spindle 40 in the transport path Pc by the transport speed of the sheet S, passes after the time t2 at which the steps g is detected.

In the following Step S112, the control mode of the feedback circuit 211 has been switched to the first control mode and an image is formed on the sheet S2. During this image formation, since the width-direction movement control is performed with the first frequency response characteristic RPh, the feedback circuit 211 rapidly reacts to the positional change of the sheet S2, and thus image formation can be favorably performed. When the image formation on the sheet S2 is completed, the transport of the sheet S is stopped in Step S113.

As described above, in this embodiment mode, the width-direction positional control is performed where the position of the sheet S is subjected to feedback control in the width direction Dw, in accordance with the detection result of the position Xe of the edge E of the sheet S. Further, when an image is formed on the sheet S, the width-direction positional control is performed with the first frequency response characteristic RPh corresponding to the relatively high frequency band Wh including a high frequency band ΔW (the first control mode); thus, the positional change of the sheet S can be rapidly reacted to and image formation can be executed favorably. In addition to the first control mode, in this embodiment mode, the second control mode can be employed where the width-direction positional control can be performed with the second frequency response characteristic RP1 corresponding to the relatively low frequency band Wl, which is lower than the high frequency band ΔW. In the second control mode, if a sharp deviation ΔX which is not used in image formation is input to the feedback circuit 211, an abrupt positional change of the sheet S made by the feedback circuit 211 can be prevented, whereby occurrence of wrinkles in the sheet S can be prevented. As a result, in this embodiment mode, favorable image formation can be realized by rapidly reacting to a positional change of the sheet S during image formation, and also occurrence of wrinkles in the sheet S can be prevented.

In addition, as in this embodiment mode, in the case where the printer 1 in which the sheet S with the step portion g at which the position of the edge E changes in the width direction Dw, is transported in the transport direction Ds, when the step portion g passes through the detection area Re as the sheet S is transported, the sharp deviation ΔX corresponding to the step portion g of the sheet S is input to the feedback circuit 211. This likely causes wrinkles in the sheet S as described above. In this embodiment mode, however, when the step portion g of the sheet S passes through the detection area Re (for example, from the time t1 to t3), the second control mode is performed. In such a manner, even when the sharp deviation ΔX is input to the feedback circuit 211 as a result of the detection of the step portion g of the sheet S, an abrupt positional change of the sheet S made by the feedback circuit 211 can be prevented, whereby occurrence of wrinkles in the sheet S can be prevented.

In addition, in this embodiment mode, the target position Xo is changed in the width direction Dw in accordance with a positional difference of the edge E of the sheet S on the downstream side and the upstream side of the transport direction across the step portion g (Step S106). By changing the target position Xo for the edge of the sheet S in the width direction Dw in accordance with the difference in the width of the sheet S across the step portion g, the position of the sheet S transported toward the recording heads 51 and 52 can be appropriately adjusted in the width direction Dw.

Note that since a change of the target position Xo is substantially an input of the sharp deviation ΔX to the feedback circuit 211, wrinkles in the recording medium may be caused as described above. To avoid this problem, the feedback circuit 211 is in the second control mode when the target position Xo is changed. In such a manner, even if the sharp deviation ΔX is input to the feedback circuit 211 as a result of the change of the target position Xo for the edge E of the sheet S, an abrupt positional change of the sheet S made by the feedback circuit 211 can be prevented, whereby occurrence of wrinkles in the sheet S can be prevented.

In addition, in this embodiment mode, the detection area Re of the edge sensor Se can be moved in the width direction Dw. Since the positional change of the detection area Re is substantially an input of the sharp deviation ΔX to the feedback circuit 211, wrinkles in the sheet S may be caused as described above. To avoid this problem, the feedback circuit 211 is in the second control mode when the detection area Re is changed in the width direction Dw (Step S108). In such a manner, even if the sharp deviation ΔX is input to the feedback circuit 211 as a result of the positional change of the detection area Re, an abrupt positional change of the sheet S made by the feedback circuit 211 can be prevented, whereby occurrence of wrinkles in the sheet S can be prevented.

Further, in this embodiment mode, after the second control mode in the Steps S103 to S110, the frequency response characteristic of the width-direction positional control is changed to the first frequency response characteristic RPh (Step S111). By changing the frequency response characteristic from the second frequency response characteristic RP1 to the first frequency response characteristic RPh in advance, the control mode can be promptly switched to the first control mode after the second control mode and the image formation in Step S112 can be started smoothly.

Further, in this embodiment mode, the operation section 140 is provided in order that the operator sets the timing to start the second control mode, and the feedback circuit 211 performs the second control mode at the timing set in the operation section 140. This enables, for example, the second control mode to be performed at any timing decided upon by the operator.

Other

As described thus far, in the above embodiment mode, the printer 1 corresponds to an example of an image formation device of the invention; the supply spindle 20, the front drive roller 31, the rear drive roller 32, and the take-up spindle 40 cooperate with each other and function as an example of a transport section of the invention; the supply spindle 20, the driven roller 21, and the width-direction drive mechanisms A20 and A21 cooperate with each other and function as an example of a width-direction positional change section of the invention; the edge sensor Se corresponds to an example of a detector of the invention; the feedback circuit 211 corresponds to an example of a control section of the invention; the recording heads 51 and 52 correspond to an example of an image formation section of the invention; the take-up spindle 40 corresponds to an example of a take-up roller of the invention; the operation section 140 corresponds to an example of a setting input section of the invention; and the sheet S corresponding to an example of a recording medium of the invention.

The invention is not limited to the above embodiment mode; a variety of modifications can be made without departing from the spirit of the invention. For example, although the frequency response characteristic of the feedback control performed by the feedback circuit 211 is switched by changing the feedback gain K of the feedback circuit 211 in the above embodiment mode, the frequency response characteristic may be switched by switching a path with a law-pass filter in the feedback circuit 211 which passes only a frequency band equal to or lower than a predetermined frequency (e.g., the frequency fl) and a path without the law-pass filter.

In addition, the timing at which to perform the second control mode is not limited to the examples described above. The width-direction positional control may be performed in the second control mode whenever the sharp deviation ΔX may be input to the feedback circuit 211, t, without limitation to the above timings.

Further in addition, although not particularly mentioned in the foregoing description, the tension applied to the sheet S may be the same or different between the first control mode and the second control mode. The tension applied to the sheet in the second control mode may be lower than that of the first control mode.

Further in addition, in the above embodiment mode, the position of the sheet S is controlled so that the central line of the sheet S coincides with the position X30 of the central line of the platen drum 30. However, it is not always necessary to control the position of the sheet S so that the central line of the sheet S coincides with the position X30 of the central line of the platen drum 30.

The configuration, place, and the number of the edge sensor Se can be appropriately changed. In addition, a specific configuration for moving the sheet S in the width direction Dw is not limited to those given above as an example. The sheet S may be moved in the width direction Dw by a configuration such as a skew correction section described in JP-A-10-086472 or by a variety of configurations which are used to control meandering of the sheet S.

The entire disclosure of Japanese Patent Application No. 2013-056288, filed Mar. 19, 2013 is expressly incorporated by reference herein.

What is claimed is:

1. An image formation device comprising:

a transport section that applies a tension to a recording medium while transporting the recording medium in a transport direction;

a width-direction positional change section that changes a position of the recording medium in a width direction that intersects the transport direction;

a detector that detects a position of an edge of the recording medium in the width direction within a detection area;

a control section that performs width-direction positional control by operating the width-direction positional change section in accordance with a detection result of the detector and by performing feedback control on the position of the recording medium in the width direction; and an image formation section that is located so as to face the recording medium and performs image formation on the recording medium, wherein the control section performs control, during the image formation, in a first control mode where the width-direction positional control is performed with a first frequency response characteristic corresponding to a frequency band including a high frequency band or in a second control mode where the width-direction positional control is performed with a second frequency response characteristic corresponding to a frequency band lower than the high frequency band.

2. The image formation device according to claim 1, wherein the transport section transports a recording medium, in the transport direction, which includes a step portion at which the position of the edge changes in the width direction.

3. The image formation device according to claim 2, wherein the control section performs the second control mode when the step portion of the recording medium passes through the detection area in the transport direction.

4. The image formation device according to claim 2, wherein the control section performs the width-direction positional control by performing feedback control such that the position of the edge of the recording medium detected by the detector approaches a target position.

5. The image formation device according to claim 4, wherein the control section performs a target position change process for adjusting, in the width direction, the position of the recording medium transported toward the image formation section by changing the target position in the width direction in accordance with a difference of the position of the edge of the recording medium on an upstream side and a downstream side of the transport direction across the step portion; and wherein the control section performs the second control mode when the target position change process is performed.

6. The image formation device according to claim 2, wherein the detection area of the detector is movable in the width direction; and wherein the control section performs the second control mode when the detection area is changed in the width direction.

7. The image formation device according to claim 2, wherein the control section changes the frequency response characteristic of the width-direction positional control to the first frequency response characteristic after the second control mode.

8. The image formation device according to claim 7, further comprising a take-up roller that takes up the recording medium on a downstream side in the transport direction from the image formation section, wherein the control section changes the frequency response characteristic of the width-direction positional control to the first frequency response characteristic after the second control mode and after the step portion of the recording medium is wrapped by the take-up roller.

9. The image formation device according to claim 1, further comprising a setting input section with which an operator sets a timing at which to perform the second control mode, wherein the control section performs the second control mode at the timing set in the setting input section.

10. The image formation device according to claim 1, wherein the control section changes the frequency response characteristic of the width-direction positional control between the first frequency response characteristic and the second frequency response characteristic by changing a feedback gain of feedback control in the width direction position control.

11. The image formation device according to claim 1, wherein the control section makes a tension of the recording medium in the second control mode lower than a tension of the recording medium in the first control mode by controlling the transport section.

12. A method of transport control for transporting a recording medium in a transport direction, comprising:

detecting a position of an edge of the recording medium in a width direction that intersects the transport direction; and performing width-direction positional control where a position of the recording medium is subjected to feedback control in the width direction in accordance with a detection result of the position of the edge of the recording medium, while switching a first control mode and a second control mode, wherein the first control mode is a mode where the width-direction positional control is performed with a first frequency response characteristic corresponding to a frequency band including a high frequency band during the image formation, and the second control mode is a mode where the width-direction positional control is performed with a second frequency response characteristic corresponding to a frequency band lower than the high frequency band.

* * * * *